United States Patent [19]

Priefert

[11] 4,226,212

[45] Oct. 7, 1980

[54] ANIMAL HOLDING GATE WITH AUTOMATIC CLOSING OPERATION

[75] Inventor: Marvin J. Priefert, Mt. Pleasant, Tex.

[73] Assignee: Priefert Mfg. Co., Mt. Pleasant, Tex.

[21] Appl. No.: 38,090

[22] Filed: May 11, 1979

[51] Int. Cl.[3] ..... A61D 3/00

[52] U.S. Cl. ..... 119/98

[58] Field of Search ..... 119/98, 99, 103, 147

[56] References Cited

U.S. PATENT DOCUMENTS

| | | | |
|---|---|---|---|
| 3,245,383 | 4/1966 | Priefert | 119/98 |
| 3,623,456 | 11/1971 | Priefert | 119/98 |

*Primary Examiner*—Jay N. Eskovitz

*Attorney, Agent, or Firm*—Rudolph L. Lowell; G. Brian Pingel

[57] ABSTRACT

An animal holding gate operable either manually to hold an animal or automatically by contact with the gate of the animal to be held. The gate has a pair of upright animal engaging members supported on a main frame for movement toward and away from each other into or out of an engaging position within the traverse confines of the main frame. Movement of the animal engaging members is controlled by a pair of levers linked to a rotatable rock shaft that serves as one side of a guideway for the upper portions of the engaging members. A spring assembly is actuable to bias the rock shaft in a direction to move the engaging members, into an animal engaging position. A trigger assembly has a catch member on the rock shaft and a latch member on the main frame which are engageable to hold the rock shaft, against the force of the spring assembly, in a rotated position in which the animal engaging members are out of an animal engaging position. The trigger assembly is released upon contact of the gate by an animal whereupon the engaging members are automatically moved into an animal engaging position by the spring assembly.

6 Claims, 9 Drawing Figures

FIG. 2
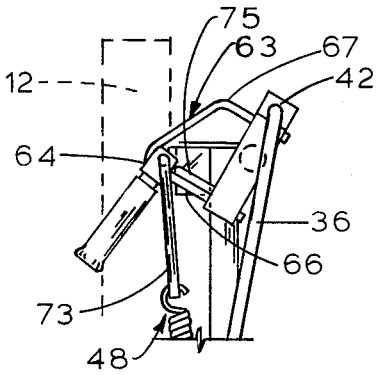
FIG. 3
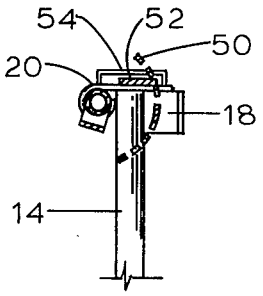
FIG. 4
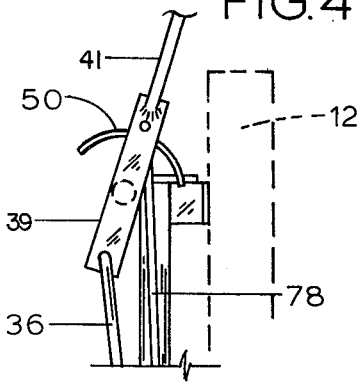
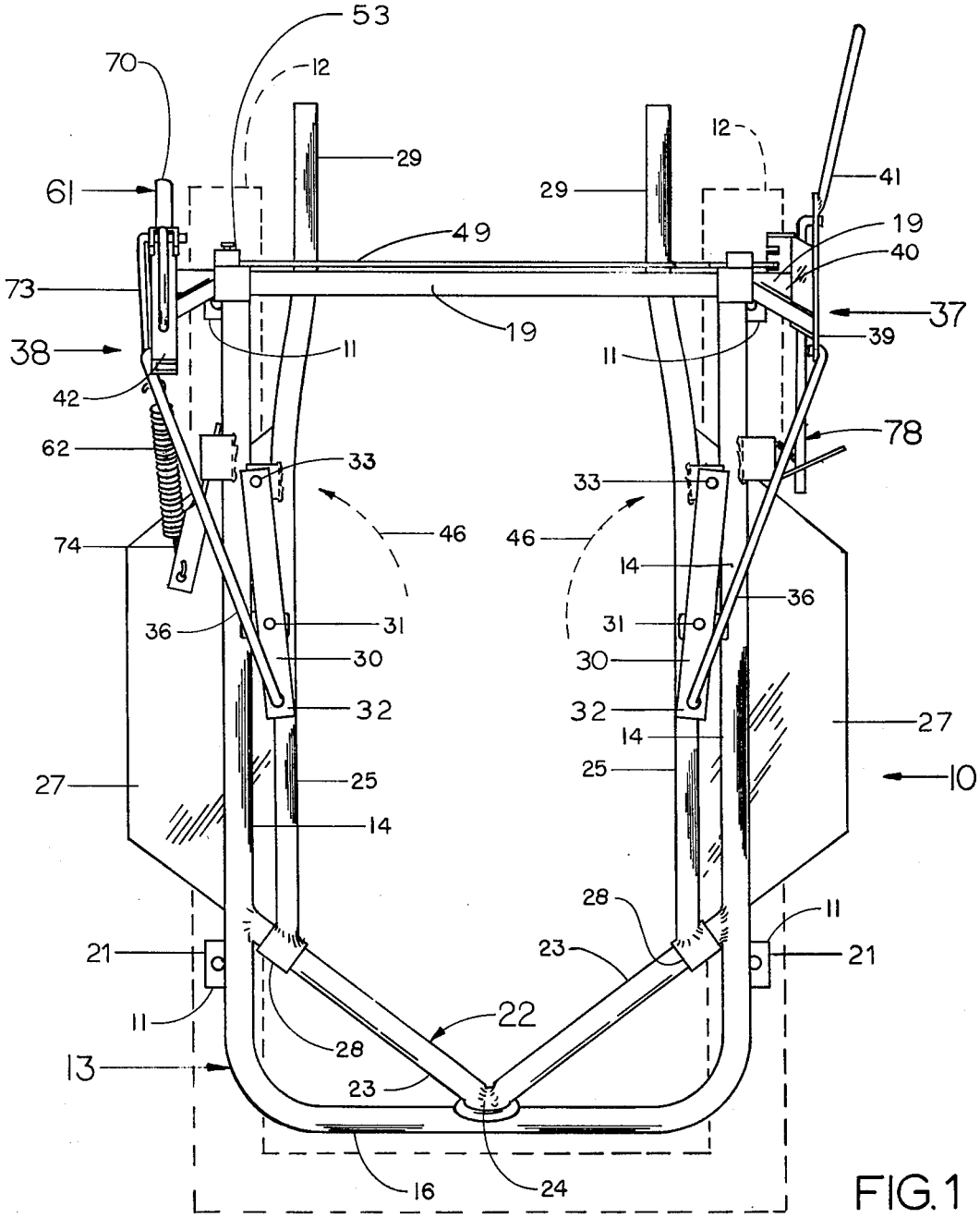
FIG. 1

ANIMAL HOLDING GATE WITH AUTOMATIC CLOSING OPERATION

BACKGROUND OF THE INVENTION

1. Field of the Invention

The present invention relates in general to a chute gate attachable to a cattle chute and having animal engaging or clamping members movable to positions for opening or closing the gate.

2. Description of the Prior Art

A wide variety of animal clamping chute gates are known in the art for holding cattle or the like in a stationary position while being medically treated. One example of such a gate is disclosed in U.S. Pat. No. 3,623,456, entitled "Chute Gate" and issued Nov. 30, 1971. The gate shown therein has a pair of upright animal engaging members supported on a main frame for simultaneous vertical and lateral movement toward and away from each other within the traverse confines of the main frame. Opening or closing movement of the animal clamping members is accomplished through a manually operated lever system.

The present invention provides a chute gate that has animal clamping members similar to those of the above described gate. However, in addition to being manually operable, the gate of the present invention can be set to automatically close upon being contacted by an animal.

SUMMARY OF THE INVENTION

The present invention provides an animal holding gate having upright animal clamping members that are moved toward or away from one another into or out of an animal clamping position in response to rotation of a rock shaft. The rock shaft may be rotated manually to move the animal clamping members into a desired position, or it may be rotated by a spring assembly when automatic closing operation of the gate is preferred.

The spring assembly is actuable to an automatic condition for applying a rotational force on the rock shaft to normally maintain the clamping members in an animal clamping position, or to a manual condition for applying an opposite rotational force on the rock shaft to assist in moving the clamping members out of an animal clamping position. With the spring assembly in an automatic condition, a trigger assembly having coacting latch means and catch means is employed to releasably hold the rock shaft and, in turn, the clamping members out of an animal clamping position against the force of the spring assembly. The latch means is movable into a position adjacent the clamping members to engage the catch means for providing such releasable holding of the rock shaft so that when an animal contacts the clamping members, the latch means is disengaged from the catch means and the rock shaft is rotated to move the clamping members into an animal clamping position.

BRIEF DESCRIPTION OF THE DRAWINGS

FIG. 1 is a front view in elevation of a preferred embodiment of the animal holding gate of the present invention shown in a fully open condition mounted on the end posts of a cattle chute;

FIG. 2 is a fragmentary side view in elevation of a side of the gate of FIG. 1 showing a spring assembly thereof in a condition for manual operation of the gate;

FIG. 3 is a fragmentary sectional view taken along line 3—3 of FIG. 1;

FIG. 4 is a fragmentary side view in elevation of a side of the gate in FIG. 1 opposite to that shown in FIG. 2;

DESCRIPTION OF THE PREFERRED EMBODIMENT

The present invention provides an animal holding gate, shown generally at 10 in FIG. 1, that is operable manually, to hold an animal, or automatically by contact with the animal to be held. The gate is fixed by mounting brackets 11 on end posts 12 of a cattle chute (not shown) of a type commonly referred to as a squeeze chute.

Figure 5:
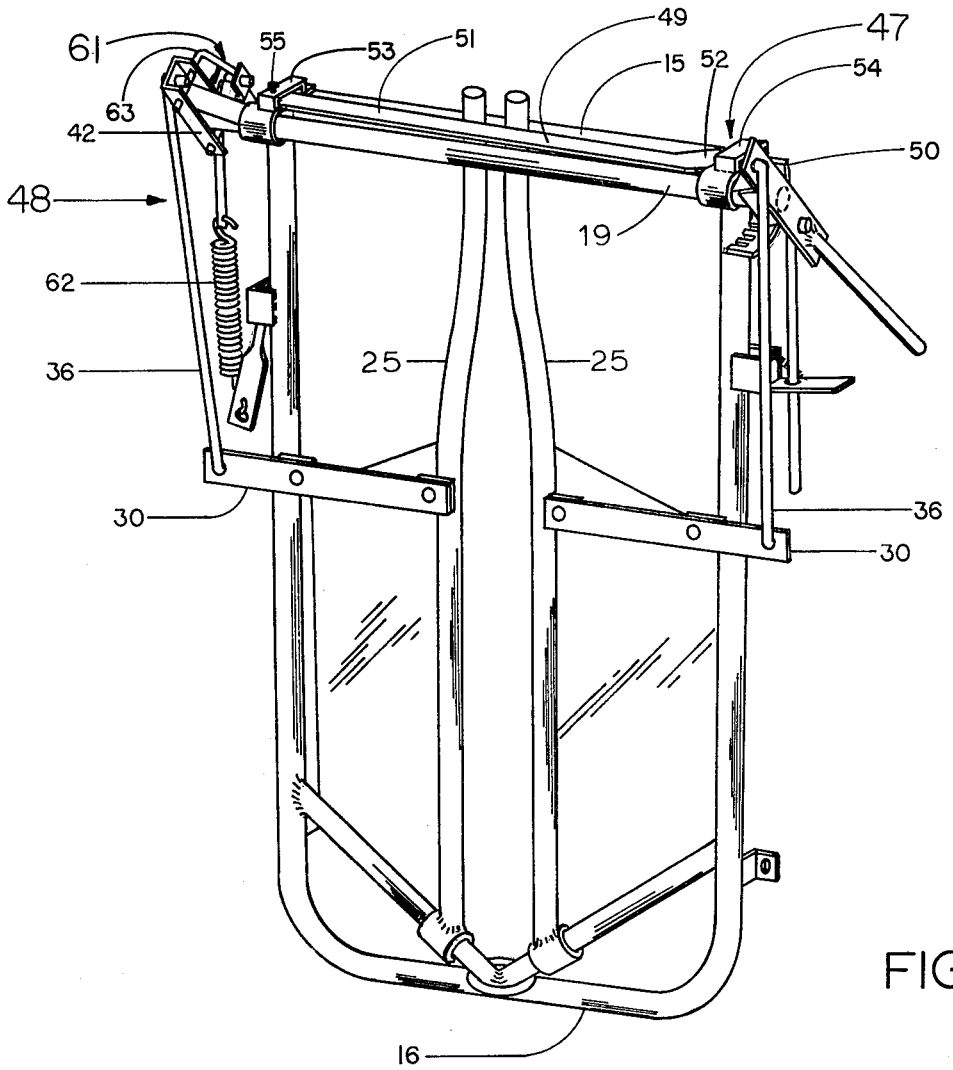
FIG. 5 is a reduced front perspective view of the gate of FIG. 1 shown in a closed condition.
Figure 8:
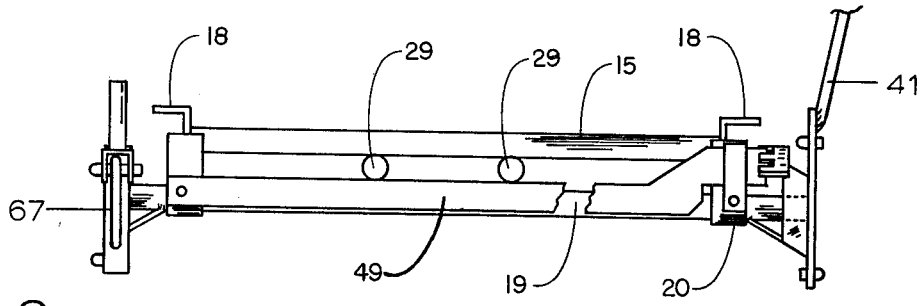
FIG. 8 is a plan view of the gate of FIG. 1 shown in a partially closed condition similar to that of FIG. 7.

The holding gate 10 includes an upright rectangularly-shaped frame 13 having a pair of vertical side members 14 connected together by upper and lower transverse bars 15 and 16, respectively (FIG. 5). As best shown in FIG. 8, the upper transverse bar 15 is secured on the top ends of the side members 14 by horizontal mounting plates 18 that are fixed to the side members 14, as by welding. A rock shaft 19 parallel to and spaced from the transverse bar 15 is rotatably mounted adjacent the top ends of the side members 14 by journal members 20. The mounting brackets 11, as shown in FIG. 1, are also carried on the side members 14 for securement to the end posts 12, preferably by screws or bolts 21.

Positioned within the plane of the upright frame 13 and at the lower end thereof is a transverse angulate member 22 of a V-shape having leg sections 23 attached at their free ends to corresponding ones of the upright side members 14 and an apex portion 24 secured to the center portion of the lower transverse bar 16.

Arranged between the side members 14 is a pair of upwright animal clamping or engaging members 25. Each of the engaging members 25 is provided at its lower end with a tubular bearing or sleeve member 28 which is mounted about and is slidably movable longitudinally of a corresponding leg section 23 of the V-shaped member 22. Upper end portions 29 of the members 25 are extendible within the space provided between the upper transverse bar 15 of the frame 13 and the rock shaft 19. The upper bar 15 and the rock shaft 19, thus, form a guideway, extended transversely of the gate, for vertically supporting the members 25 while permitting relative lateral movement therebetween. Lateral and vertical movements of the members 25 occur simultaneously in response to the riding action of the members 25 longitudinally of the leg sections 23 of the V-member 22.

When the lower portions of the animal engaging members 25 are moved to their innermost positions adjacent to the apex 24 of the V-member 22 (FIG. 5), the members 25 are engageable with the neck of an animal located therebetween. These innermost positions define a closed position of the gate 10. Conversely, when the members 25 are moved to their outermost positions, as shown in FIG. 1, the holding gate 10 is in its open position to provide for the free movement of an animal through the gate 10 between the members 25 and over the V-member 22. In this connection, it should be noted that the upright frame 13, the V-member 22 and animal clamping members 25 are all of a tubular pipe construction so as to reduce possible injury to an animal striking thereagainst. Also, upright closure plates 27 fixed to the members 25 are movable therewith to block off the space between the members 25 and side members 14 when the members are in clamping position, to prevent an animal from attempting to pass therebetween.

To move the engaging members 25 to the open and closed positions of the gate 10, a pair of levers 30 are pivoted intermediate their ends at 31 on adjacent ones of the side members 14. Each lever 30 has one end pivoted at 33 to a corresponding engaging member 25 and an opposite end 32 pivotally connected to the lower terminal portion of an upright link 36.

For the purpose of clarity of description, the right and left hand sides of the gate 10, as shown in FIG. 1, will be hereafter referred to as the operating side 37 and the shift side 38, respectively. The link 36 on the operating side 37 of the gate 10 has an upper terminal portion pivotally connected to a rock arm 39 that has a medial portion secured to the end 40 of the rock shaft 19 (FIG. 4). The rock arm 39 is also secured to a handle 41 by which the rock shaft 19 can be manually rotated.

The link 36 on the gate shift side 38 has an upper terminal portion pivotally connected to a rock arm 42 of channel shape which faces (FIG. 5) toward and has a medial portion secured to the end 44 of the rock shaft 19. Thus, the levers 30 are interconnected with the rock shaft 19 via the links 36 and the rock arms 39 and 42.

When the gate 10 is in a closed position (FIG. 5) the levers 30 are extended inwardly toward each other in a substantially horizontal plane. With the gate 10 in an open position, as shown in FIG. 1, the levers 30 are in upright positions. During movement of the animal clamping members 25 from a gate closing position to a gate opening position, the pivot connections 33 travel along an arcuate path 46, shown in dotted lines in FIG. 1.

The gate 10 may be manually opened or closed by manipulation of the handle 41 to rotate the rock shaft 19. However, the gate 10 may also be operated automatically for catching an animal as will now be described.

Figure 7:
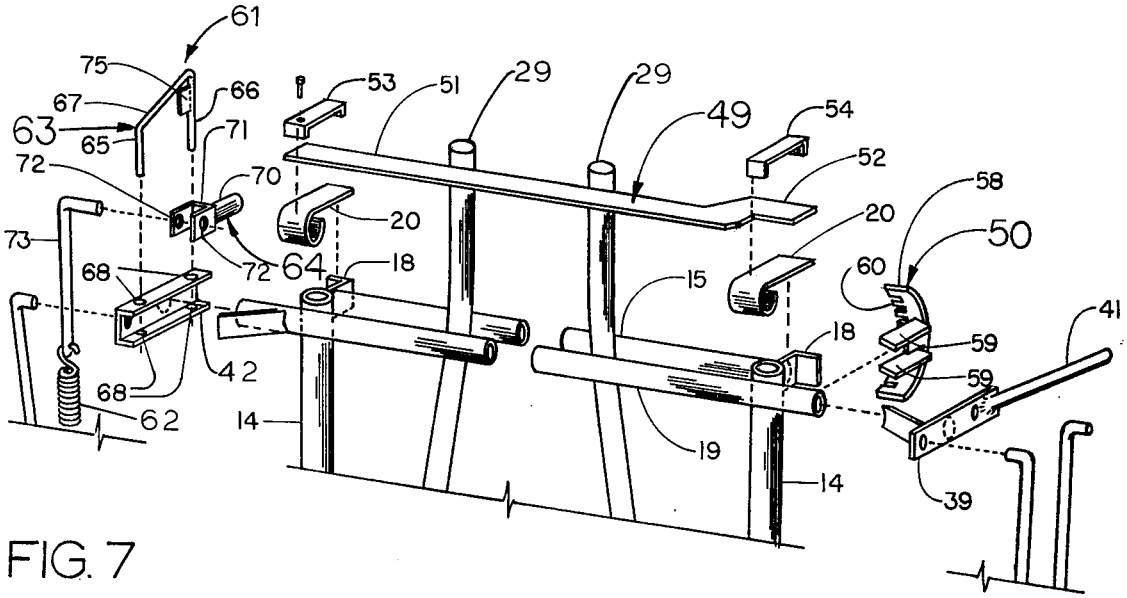
FIG. 7 is an exploded fragmentary front perspective view of the gate of FIG. 1 showing the animal engaging members in a partially closed condition.

To provide for an automatic operation, the gate 10 has a trigger assembly 47 and a spring assembly 48 (best shown in FIGS. 5 and 7). The trigger assembly 47 includes an elongate latch member 49 disposed above the rock shaft 19, and a catch member 50 secured on the rock shaft 19 adjacent the rock arm 39. The latch member 49 is formed of a thin, flat bar extended transversely of the gate having a body portion 51 parallel to the rock shaft 19 and an offset end portion 52. A pair of bridge members 53 and 54 are welded on the upper surface of the rock shaft journal members 20 for confining movement of the latch member 49. The body portion 51 of the latch member 49 is pivoted at 55 to the bridge member 53 and the off-set end portion 52 is laterally movable between the ends of the bridge member 54 (as shown in FIG. 3).

The catch member 50, as shown in FIG. 7, is composed of a semi-circularly shaped ring portion 58 having a pair of mounting arms 59 extended from the concave side thereof for securing the member 50 to the rock shaft 19 for rotational movement therewith. One side edge of the ring portion 58 has a plurality of notches 60, for selectively engaging the offset end portion 52 of the latch member 49. Thus, the rock shaft 19 can be rotated from a gate closing position, against the action of the spring assembly 48 to a desired gate open position and then releasably locked in the desired position by engagement of the latch and catch members 49 and 50, respectively. It should be noted that when the latch and catch members 49 and 50, respectively, are engaged, the latch member 49 is against the upper portions 29 of the animal engaging members 25 (as shown by FIG. 8) which in turn abut against the upper transverse cross bar 15. The space between the upper transverse bar 15 and the rock shaft 19 permits a movement of the upper portions 29 of the engaging members 25 toward the rock shaft 19 sufficient to pivot the latch member 49 about the pivot 55 to disengage the latch and catch members 49 and 50, respectively, whereupon the spring assembly 48 returns the rock shaft 19 to a gate closing position.

Figure 9:
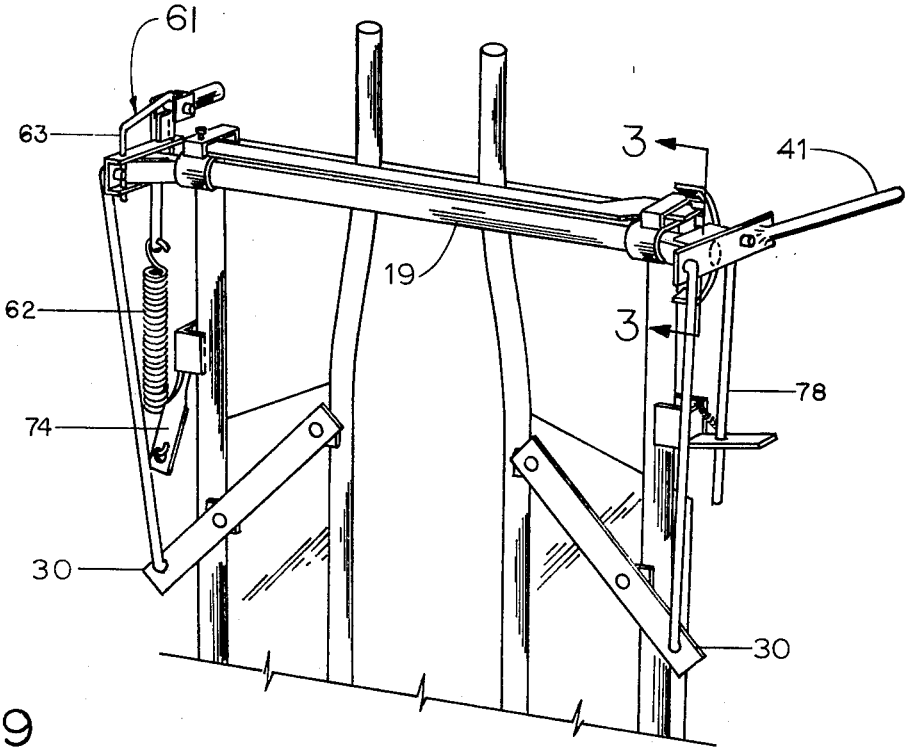
FIG. 9 is a fragmentary front perspective view of the gate of FIG. 1 shown in a partially closed condition similar to that of FIG. 7.

The spring assembly 48 is located on the shift side 38 of the gate 10, and includes a shift unit 61 (FIG. 5 and 9) that is attached to a coil spring 62. Referring to FIG. 7, the shift unit 61 has a generally U-shaped shift rod 63 on the legs of which is slidably mounted a shift lever 64. The shift rod 63 is of a rod construction and has a short leg 65, a long leg 66 parallel to the leg 65, and a center base portion 67 inclined therebetween. The legs 65 and 66 are inserted through mounting holes 68 in the channel rock arm 42.

The shift lever 64 has a handle portion 70 having a yoke portion 71 at one end formed with a pair of aligned apertures 72. A right angle connecting rod 73 has one terminal portion disposed in the apertures 72 to fasten the shift lever 64 to the shift rod 63. An opposite terminal portion of the rod 73 is connected to one end of the coil spring 62, which is connected at its other end to a bracket member 74 (FIGS. 1 and 8) releasably secured to an adjacent side member 14 of the chute gate. The connection of the spring 62 to the shift lever 64, is such that the tension of the spring 62 and the direction of the resulting spring force can be adjusted by movement of the shift lever 64 on the shift rod 63.

Figure 6:
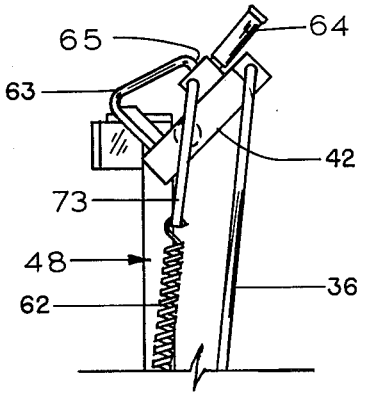
FIG. 6 is a fragmentary side view similar to that of FIG. 2 with the spring assembly shown in a condition for automatic operation of the gate.

Referring to FIGS. 2 and 6, the spring assembly 48 is shown rotated to an extreme counterclockwise position that corresponds to the closed position of the gate 10. In such position, the end of the rock arm 42 connected to the link 36 is at the highest elevation it reaches during spring assembly rotation. In FIG. 6, the shift lever 64 is positioned on the shift rod short leg 65 adjacent the link 36 so that the spring 62 is under maximum tension, and located to the right of the connection between the rock shaft 19 and the rock arm 42. Consequently, the spring 62 is in a position to exert a force on the rock arm 42 urging clockwise rotation thereof to assist in a manual opening of the gate 10. In contrast, in FIG. 2, the shift lever 64 is positioned on the long leg 66 of the shift rod 63 between a shoulder 75 thereon and the center base portion 67. The shoulder 75 serves to space the shift lever 64 from the rock arm 42 to increase the force exerted thereon by the spring 62, which is partially extended and located to the left of the connection between the rock shaft 19 and the rock arm 42. As a result, the spring now exerts a force on the rock arm 42 urging counterclockwise rotation thereof so as to oppose an opening of the gate 10 and serving to automatically close the gate when the trigger assembly 47 is actuated as previously described. Thus, the gate 10 may be set for automatic operation or for manual closing operation merely through adjustment of the shift lever 64 on the shift rod 63.

To load the gate 10 for an automatic closing operation, the rock shaft 19 is rotated by means of the handle 41 to partially open the gate 10 to permit only the head of an animal to pass between the neck clamping rods 25. The off-set or hook end 52 of the latch member 49 is then inserted into one of the notches 60 of the catch member 50 to hold the gate in such partially open position. It should be noted that although the notches 60 extend along an entire side of the arcuate member 50, only the top three notches 60 are used in the operation of the gate 10 as described. The bottom three notches 60 are used only when the gate is assembled with the operating and shift sides 37 and 38, respectively, reversed to permit operation of the gate from either side as desired.

Once the gate 10 is loaded or set for automatic operation, an animal in the squeeze chute, on which the gate is mounted is prodded to stick its head between the neck engaging members 25 until its shoulders come in contact therewith. Such contact moves the upper portions 29 of the engaging members forward to pivotally move the latch member off-set end 52 out of engagement with the catch member 50. Thereupon, the force of the spring 62 automatically closes the gate 10 with the members 25 engaging opposite sides of the animal's neck. To release the animal, the gate 10 is fully opened upon rotation of the rock shaft 19 by use of the handle 41, whereby the engaging members 25 are moved to their outermost positions of FIG. 1.

A releasably locking of the gate 10 in a neck engaged position to hold an animal therein may be accomplished by use of a friction lock mechanism 78, as disclosed in my prior U.S. Pat. No. 3,623,456 issued Nov. 30, 1971, entitled "Chute Gate" and entirely incorporated herein by reference.

Although the invention has been described with respect to a preferred embodiment thereof, it is to be understood that it is not to be so limited since changes and modifications can be made therein which are within the full intended scope of this invention as defined by the appended claims .

I claim:

1. An animal holding gate comprising:

(a) an upright main frame having a pair of transversely spaced side members and bottom and top cross members, (b) an upright animal engaging member for each of said side members having a lower portion guidably connected to said bottom cross member for movement laterally of said main frame, (c) a lever corresponding to each of said animal engaging members pivotally supported intermediate the ends thereof on an adjacent side member having a first end portion and a second end portion pivotally connected with an associated animal engaging member, (d) a transverse rock shaft rotatably mounted on said main frame adjacent the upper ends of said side members in a horizontally parallel spaced relation with said top cross member to form therewith a guideway for guidably supporting the upper ends of said animal engaging members for movement laterally of the gate, (e) a pair of rock arms on said rock shaft each of which is movably connected with the first end portion of an associated lever whereby said animal engaging members are moved laterally toward or away from each other into or out of animal engaging position in response to a rotational movement of said rock shaft, (f) catch means mounted on said rock shaft for rotation therewith, (g) latch means movably mounted on said main frame for movement into an engagement with said catch means to hold said rock shaft in a selected rotated position when said animal engaging members are out of an animal engaging position, said latch means mounted adjacent the upper portion of at least one of said animal engaging members, whereby said latch means and said catch means are disengaged upon movement of said one animal member through contact with an animal, and (h) yieldable pressure means acting on said rock shaft to urge said shaft out of said selected rotated position, whereby on disengagement of said catch and latch means said animal engaging members are automatically moved into an animal engaging position.

2. An animal holding gate as recited in claim 1, wherein:

(a) said catch means comprises:

(1) a circularly shaped ring portion having a side edge formed with a plurality of notches;

(2) mounting means for securing said ring portion to said rock shaft; and (b) said latch means comprises:

() a generally straight body portion having one end pivotally secured to said main frame and an opposite end terminable in an offset portion for selective engagement with one of said plurality of notches of said catch means to hold said rock shaft in a desired rotated position.

3. An animal holding gate as recited in claim 1 wherein:

(a) said yieldable pressure means includes spring means connected at one end to one of said pair of rock arms and at an opposite end to said main frame.

4. An animal holding gate as recited in claim 3, wherein said yieldable pressure means further includes:

(a) a U-shaped shift rod having the legs thereof secured to opposite ends of one of said pair of rock arms; and (b) a shift lever movably mounted on said shift rod and connected to said spring means to provide the connection of said spring means to said one rock arm whereby movement of said shift lever on said shift rod moves said spring to a position for rotating said rock shaft in a desired direction.

5. An animal holding gate as recited in claim 4, wherein:

(a) one of said opposite ends of said one rock arm is connected with the first end portion of said associated lever; and (b) one of the legs of said shift rod is of a shorter length than the other of said legs, and (c) an abutment portion on said one leg adjacent said one rock arm, with said one leg located adjacent the connection of said one rock arm and associated lever.

6. An animal holding gate as recited in claim 1, including:

(a) an upright closure plate associated with each of said animal engaging members and extended between an engaging member and said main frame to hold an animal from passing therebetween.

* * * * *